United States Patent [19]

Stanton

[11] Patent Number: 4,586,847

[45] Date of Patent: May 6, 1986

[54] VIBRATORY MECHANISM

[75] Inventor: Raymond J. Stanton, Sydney, Australia

[73] Assignee: RayGo, Inc., Minneapolis, Minn.

[21] Appl. No.: 638,124

[22] Filed: Aug. 6, 1984

[30] Foreign Application Priority Data

Feb. 10, 1984 [AU] Australia ..... 24500/84

[51] Int. Cl.[4] ..... E01C 19/38

[52] U.S. Cl. ..... 404/117; 74/61; 74/87; 366/128; 172/40; 172/97

[58] Field of Search ..... 404/117, 122; 74/61, 74/87; 172/40, 97; 209/366.5; 366/128

[56] References Cited

U.S. PATENT DOCUMENTS

| | | | |
|---|---|---|---|
| 2,703,490 | 3/1955 | Brueggeman | 74/61 |
| 3,108,520 | 10/1963 | Garis et al. | 404/117 |
| 3,257,918 | 6/1966 | Garis et al. | 404/117 |
| 3,543,656 | 12/1970 | Roettger | 404/117 |
| 3,616,730 | 11/1971 | Boone et al. | 404/117 |
| 3,656,419 | 4/1972 | Boone | 404/117 |
| 3,722,381 | 3/1973 | Tuneblom | 74/87 X |
| 3,814,532 | 6/1974 | Barrett et al. | 404/117 |
| 3,896,677 | 7/1975 | Larson | 74/61 |
| 3,909,147 | 9/1975 | Takata | 404/117 |
| 4,113,034 | 9/1978 | Carlson | 74/61 |

FOREIGN PATENT DOCUMENTS

| | | | |
|---|---|---|---|
| 464339 | 7/1975 | U.S.S.R. | 74/61 |
| 563274 | 6/1977 | U.S.S.R. | 366/128 |

*Primary Examiner*—Stephen J. Novosad
*Assistant Examiner*—John F. Letchford
*Attorney, Agent, or Firm*—Burd, Bartz & Gutenkauf

[57] ABSTRACT

A road compacting drum is equipped with a dual amplitude, rotational, vibratory mechanism. A shaft rotatably mounted on the drum supports eccentric weights. Casings secured to the shaft adjacent the weights have chambers accommodating fluent mass. The fluent mass comprise metal members, as steel balls, shot or liquid metal, that move to a first location in the chamber upon rotation of the shaft in one direction to increase the amplitude of the vibration of the shaft and drum. The fluent mass flows to a second location in the chamber in response to rotation of the shaft in a direction opposite the one direction to generally balance the shaft to reduce the amplitude of vibration of the shaft and drum.

25 Claims, 8 Drawing Figures

VIBRATORY MECHANISM

FIELD OF INVENTION

The invention is in the field of vibration mechanics utilizing rotational mechanisms for changing the amplitude of the vibration of an apparatus. The vibratory mechanism is useable in road compacting machines having drums that are vibrated to achieve a desired compacting function.

BACKGROUND OF INVENTION

In one known self propelled vibrating road roller the compactor drum is vibrated at 1700 rpm by a dual amplitude vibratory mechanism which utilizes a swinging weight. The compactor drum rotates at vehicle speed as the vehicle moves forward. The drum is supported on the vehicle frame by anti-vibration mountings. An axial, reversible drive shaft at the center of the drum is driven by a hydraulic motor from the vehicle. The drum shaft has, in addition to a fixed eccentric weight, a hinge pin parallel to the axis of the shaft, a pocket for accommodating the swinging weight and stops to limit the travel of the swinging weight. When the shaft rotates in one direction, the swinging weight turns on the hinge pin to an eccentric position which adds to the fixed eccentric weight and increase the eccentric moment. When the shaft rotation is reversed by the operator, the hinged weight turns again on the hinge pin to the extent limited by the remaining stop and subtracts from the eccentric moment. The impact of the weight on the stops at each halt, start and reversal eventually produces metal particles in the mechanism which contaminate the bearings causing consequential failure and the drum must be disassembled to give access for repair.

SUMMARY OF INENTION

The invention concerns a dual amplitude, rotational, vibratory mechanism in which the amplitude of the vibration can be changed by reversing the direction of the rotation of the mechanism. The vibratory mechanism is useable with a compactor drum of a road compacting machine. The utility of the vibratory mechanism is not limited to road compacting machines. The vibratory mechanism can be used with mineral crushers and separators, feed mechanisms for particulate material and like machines.

The vibratory mechanism has a shaft rotatably mounted on the member to be vibrated. Weight means are eccentrically associated with the shaft to provide a first eccentric mass which causes the shaft to vibrate upon rotation thereof. Means mounted on the shaft has a fluent second mass which upon shaft rotation in one direction flows to a first position to augment the eccentric distribution of the first mass thereby producing a high amplitude vibration of the shaft and member and upon rotation of the shaft in the opposite direction the fluent second mass flows to a second position which tends to balance the eccentricity and produce low amplitude vibration of the shaft and member.

In one embodiment of the invention, a shaft is rotatably mounted on a housing with a plurality of bearings. The housing is secured to a drum of a road compacting machine. Weight means fixed to the shaft provides an eccentric first mass. Means having a fluent second mass includes a casing or capsule secured to the shaft. The casing has a chamber accommodating the fluent second mass. The fluent second mass may be a plurality of metal members such as small steel balls, cast iron shot, or liquid metal. The casing has at least one partition located within the chamber which upon rotation of the shaft confines the fluent second mass to separate portions of the chamber to either augment or balance the first mass. The shaft is rotated with a reversible motor. When the shaft is rotated in a first direction the fluent mass flows to the first position thereby producing a high amplitude vibration of the shaft and member. When the shaft is rotated in the reverse or second direction the fluent mass moves to the second direction the fluent mass moves to the second location thereby producing a low amplitude vibration of the shaft and member.

Another embodiment of the invention has a shaft drivably connected to a reversible motor. The shaft is mounted for rotation on a member, such as a drum. A pair of casings having chambers for accommodating fluent mass are mounted on axially spaced portions of the shaft. For example, the casings can be mounted adjacent opposite ends of the shaft. Each casing has partition means that separate the chamber into first and second locations for the fluent mass. Weight means are mounted on the shaft adjacent each casing. The weight means is positioned adjacent the first locations. The motor operates to rotate the shaft in a first direction causing the fluent mass to flow to the first position thereby producing a high amplitude vibration of the shaft and member. When the motor drive is reversed the shaft if rotated in a second direction or opposite the first direction causing the fluent mass to flow to the second position thereby producing a low amplitude vibration of the shaft and member.

The pair of casings accommodating the fluent second mass disposed symmetrically about the axial center of the shaft are preferred over a single central casing and weight means. The use of a single casing requires a stiffer shaft to resist deflection.

An alternate embodiment of the vibratory mechanism, has a shaft rotatably mounted in an eccentric position relative to the support bearings. An additional eccentric mass can be fixed to the shaft. Maximum difference in the eccentric moment between high and low amplitude modes is achieved with a concentric path for the fluent second mass. Acceptable performance is achieved with an eccentric path or ring-like path containing pockets or lobes for accommodating the fluent second mass.

DESCRIPTION OF PREFERRED EMBODIMENT

A self propelled vibrating roller in which this embodiment of the invention is useful has a front drum and a rear drum each mounted in its own frame on anti-vibration mountings. Each drum has a cylindrical steel shell having diminsions of 1500 mm diameter, 2000 mm long and about 25 mm thick. The drum weighs about 3500 kg. The mr value of the eccentric mechanism suitable for rollers of the heavier class is in the range from 4–10 kg meters. The drum displacement is of the order of 3 mm at high amplitude mode and about 1.5 mm at low amplitude mode.

Figure 1:
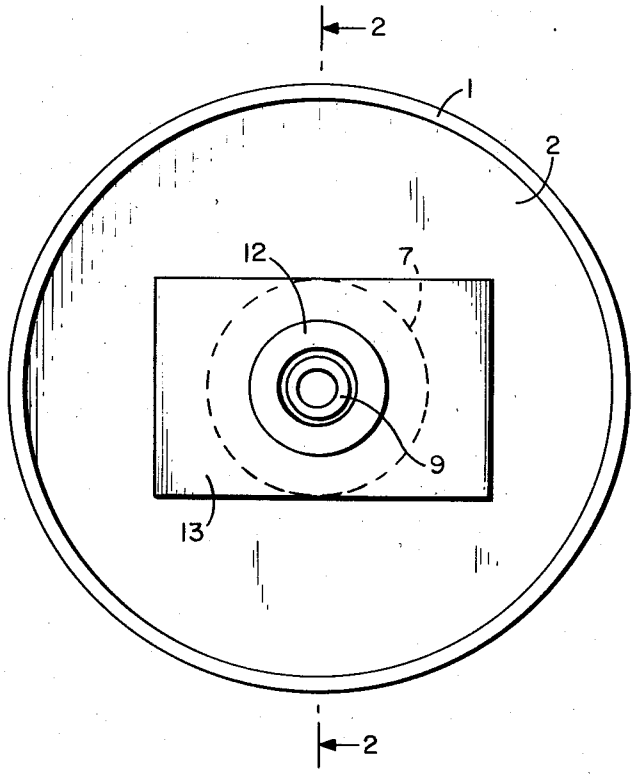
FIG. 1 is an end view of a drum of a vibrating roller of a road compacting machine equipped with the vibratory mechanism of the invention.
Figure 2:
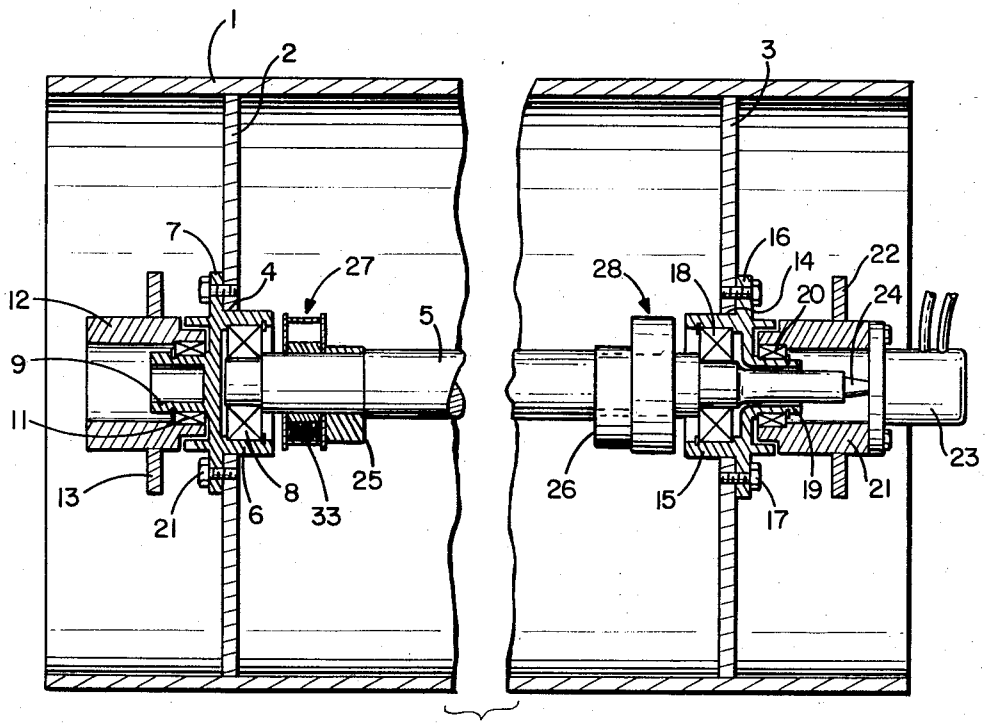
FIG. 2 is a foreshortened sectional view taken along the line 2—2 of FIG. 1.

Referring to FIGS. 1 and 2, the drum has a cylindrical shell 1 and a pair of circular plates or ends 2 and 3 located inwardly from the opposite ends of shell 1. End 2 has a central aperture 4 aligned with central aperture 14 in end 3. A shaft 5 and vibratory mechanisms 23 and 24 pass through one of the apertures and are located between ends 2 and 3. Shaft 5 is a steel shaft having sufficient size to resist deflection. Preferrably, shaft 5 has a diameter of 188 mm. Other shaft sizes can be used.

A cup-shaped cylindrical housing 6 extends through aperture 4. Housing 6 has an outwardly directed flange 7 secured to end 2 with bolts 21. A bearing 8 located within housing 6 rotatably supports one end of shaft 5 on housing 6. Housing 6 has an outwardly directed stub axle 9. A bearing 11 supports a sleeve 12 on axle 9. Sleeve 12 is secured to a plate 13 used to support the drum 1 on the vehicle (not shown).

End 3 has a central aperture 14 accommodating a cup-shaped housing 15. Housing 15 has an outwardly directed flange 16 secured to end 3 with bolts 17. A bearing 18 located within housing 15 rotatably supports one end of shaft 5 on housing 15. Bearings 8 and 18 mount shaft 5 on housings 6 and 15 for rotation about the longitudinal axis of shaft 5. Alternatively, shaft 5 can be eccentrically mounted in bearings 8 and 18. Housings 6 and 15 close apertures 4 and 14 and prevent the entrance of water and foreign matter into the drum chamber between ends 2 and 3.

Housing 15 has an outwardly directed stub axle 19 accommodating a bearing 20. A sleeve 21 mounted on bearing 20 is secured to a plate 22. Plates 13 and 22 are attached to vehicle structure to secure drum 1 to the vehicle.

A reversible hydraulic motor 23 is connected to end 24 of shaft 5. Motor 23 is connected with suitable hydraulic lines to a source of hydraulic fluid under pressure and control valves (not shown) which allow the operator of the vehicle to control the operation of motor 23 to change the direction of rotation of shaft 5 as well as the speed of rotation of shaft 5.

Figure 6:
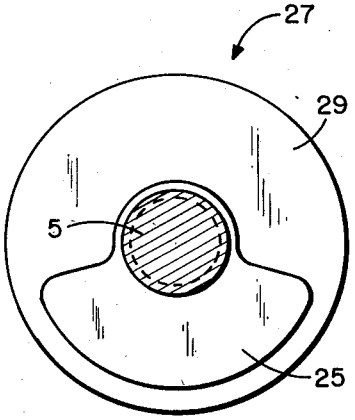
FIG. 6 is a sectional view taken along the line 6—6 of FIG. 3.

A pair of weights 25 and 26 are mounted on shaft 5 adjacent the opposite ends thereof. Weights 25 and 26 have eccentrically located masses which cause shaft 5 to vibrate when it is rotated. As shown in FIG. 6, mass 25 has an arcuate configuration off set from the axis of rotation of shaft 5 and an arcuate length less than 180 degrees. Weight 26 has a shape and displacement that is the same as weight 25.

Figure 4:
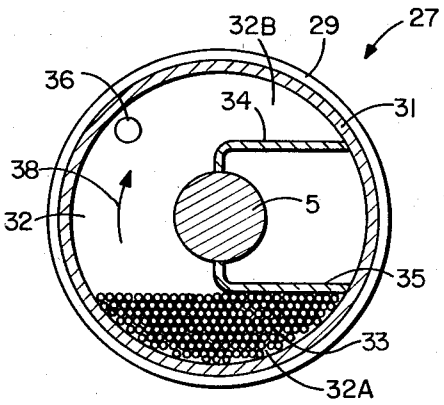
FIG. 4 is a sectional view taken along the line 4—4 of FIG. 3 showing the location of the fluent second mass in the high amplitude mode.
Figure 8:
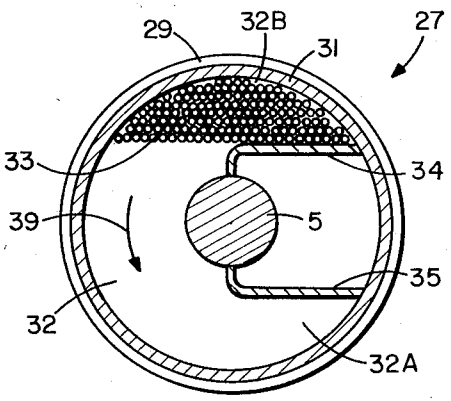
FIG. 8 is a sectional view taken along the line 8—8 of FIG. 7.
Figure 3:
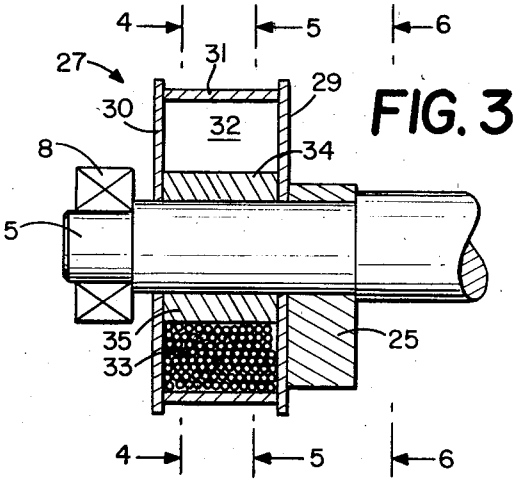
FIG. 3 is an enlarged sectional view of a vibratory mechanism mounted on a shaft as shown in FIG. 2.
Figure 5:
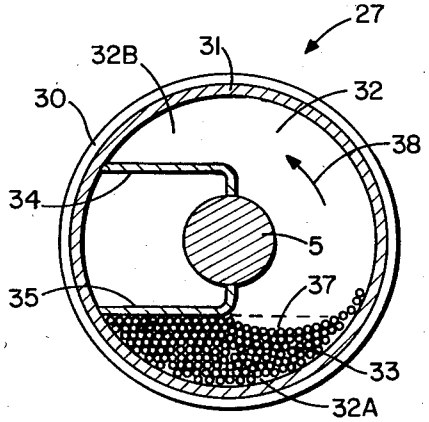
FIG. 5 is a sectional view taken along the line 5—5 of FIG. 3 showing the distribution of the fluent second mass during stroboscobic examination.

Returning to FIG. 2, a pair of vibratory units indicated generally at 27 and 28 are mounted on shaft 5 adjacent weights 25 and 26. Vibratory units 27 and 28 are identical in structure. The following description is directed to vibratory unit 27. As shown in FIG. 3, vibratory unit 27 has a sealed, hollow capsule or casing that accommodates a fluent mass 33. The casing has circular end walls 29 and 30 mounted on shaft 5. A circumferential outer wall or raceway 31 is secured to the outer peripheral edges of end walls 29 and 30 and define therewith a chamber 32. Chamber 32 is concentric with the axis of rotation of shaft 5. Fluent mass 33 is located in chamber 32. The fluent mass 33 is a movable weight, such as plurality of metal members, steel balls, metal shot, liquid metal, sand, and like flowable ballast material. As shown in FIGS. 4, 5, and 8 less than half of chamber 32 is filled with fluent mass 33. Walls 34 and 35 located in chamber 32 are secured to opposite sides of shaft 5 and extend along separate chord lines to outer wall 31. Walls 34 and 35 are stops for fluent mass 33 that divide chamber 32 into a first portion 32A and a second portion 32B. Chamber portions 32A and 32B are located diametrically opposite from each other as shown in FIG. 4. Wall 29 has a normally closed port or opening 26 through which fluent mass 33 is introduced into chamber 32. Walls 34 and 35 can be substantially radial walls that extend from shaft 5 to outer wall 31. These walls can be angularly disposed from each other at an angle from about 80 to 135 degrees and define the oppositely disposed chambers 32A and 32B for fluent mass 33.

In use, the maximum vibration amplitude is achieved by rotating shaft 5 in the direction of the arrow 38, as shown in FIGS. 4 and 5. Hydraulic motor 23 drives shaft 5 independent of the speed of rotation of the shell 1. Fluent mass 33 moves into the chamber portion 32A against wall 35. As shown in FIG. 3, fluent mass 33 is located adjacent the eccentric first mass or weight 25 thereby increasing the eccentric mass that rotates with shaft 5. This increases the amplitude of the vibration of shaft 5 and shell 1.

Figure 7:
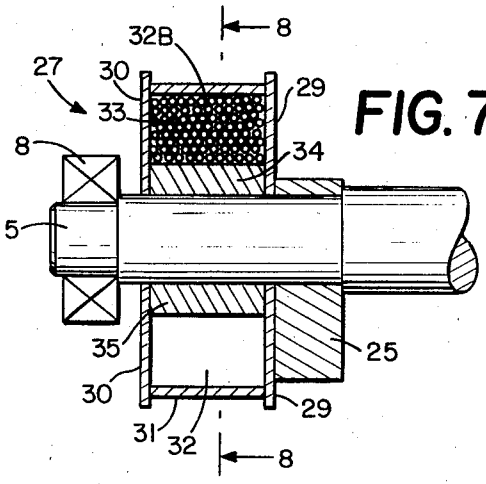
FIG. 7 is a sectional view similar to FIG. 3 showing the location of the fluent second mass in low amplitude mode.

The rotation of shaft 5 in the opposite direction indicated by the arrow 39 in FIG. 8 causes fluent mass 33 to move into second chamber portion 32B. As shown in FIG. 7, chamber portion 32B is diametrically opposite weight 25 whereby the fluent second mass counteracts weight 25 and tends to balance shaft 5. This reduces the amplitude of the vibration of shaft 5 and shell 1.

Referring now to FIG. 5, a phenomenon is observable during stroboscopic examination of the shaft 5 and unit 27 when revolving at working speed in the direction of arrow 38. Under the combined effects of friction and centrifugal force the fluent mass 33 assumes the crescent shaped surface as shown at 37. The magnitude of the eccentric moment of the fluent mass 37 in practice varies only slightly from the magnitude of the eccentric moment of the theoretical fluent mass and is considered to be within acceptable tolerance limits. The actual eccentric moment is slightly less than the theoretical value but can easily be brought up to the theoretical value by a small increase in mass of the fluent mass.

The Relative Magnitude of Eccentric Moment of the fluent mass can be calculated as follows:

Let M=total eccentric moment required for high amplitude mode.

Let aM=total eccentric moment required for low amplitude mode.

where a=ratio of low/high amplitude

Let x=eccentric moment of the fixed eccentric mass

Let y=eccentric moment of the fluent mass

The following simultaneous equations apply $$x+y=M \qquad 1$$

$$x-y=aM \quad 2$$

by subtraction $$2y = M - aM \quad 3$$

$$\therefore y = \frac{(M - aM)}{2}$$

substituting in equation 1

$$X + \frac{(M - aM)}{2} = M \quad 4$$

$$\therefore x = \frac{(M + aM)}{2}$$

Generally "a"=0.5 thus low amplitude is half the high amplitude but by altering the ratio of fluent mass 33 to the fixed mass 25 a can be made to other than 0.5.

The advantages of the vibratory mechanism are as follows: impact loads are rendered insignificant because the fluent mass 33 constitute multiple small masses which accelerate and decelerate without producing the impact damage associated with a swinging weight. The fluent mass 33 is confined within a sealed casing which eliminates bearing damage from consequential failure. The casings of unis 27 and 28 are maintenance free and are located in the protected drum chamber.

While there has been shown and described the vibratory mechanism of the invention, it is understood that changes in the structure and use of the mechanism may be made by those skilled in the art without departing from the invention. For example, weights 25 and 26 can be crescent-shaped pieces of metal that are secured by welds or the like to the end walls 29 of vibratory units 27 and 28. The internal walls 34 and 35 can have other shapes, such as radial to provide the separate chamber portions 32A and 32B for the fluent second mass 33. The outer wall 31 can have a plurality of symmetrical lobes for accommodating the fluent second mass 33.

The invention is defined in the following claims.

I claim:

1. A vibratory mechanism for vibrating a member comprising: a shaft, means for rotatably mounting the shaft on the member, means for selectively rotating the shaft in opposite circumferential directions, weight means eccentrically mounted with respect to said shaft for rotating therewith to vibrate said shaft when rotationally driven, and means mounted on the shaft having a fluent mass which upon shaft rotation in one direction moves to a first location adjacent the weight means to augment the eccentric distribution of said weight means thereby producing high amplitude vibration of the member and upon rotation of the shaft in the opposite direction said fluent mass moves from the first location to a secod location spaced from the weight means which tends to balance the eccentricity of the weight means to produce low amplitude vibration of the member.

2. The mechanism of claim 1 wherein: the means for rotatably mounting the shaft on the member include bearings rotatably supporting the shaft for rotation about the longitudinal axis thereof.

3. The mechanism of claim 1 wherein: the weight means is fixed to the shaft adjacent the means mounted on the shaft having a fluent mass and adjacent the first location for the fluent mass.

4. The mechanism of claim 1 wherein: the fluent mass comprises a plurality of metal members.

5. The mechanism of claim 1 wherein: the fluent mass comprises a liquid metal.

6. The mechanism of claim 1 wherein: the means mounted on the shaft having fluent mass comprise casing means having a chamber accommodating the fluent mass, said chamber having said first location and second location for the fluent mass, said weight means being mounted on the shaft adjacent the first location of the casing means.

7. The mechanism of claim 6 wherein: the casing means comprises a plurality of casings mounted on the shaft, each casing having a chamber accommodating fluent mass, each chamber having said first and second locations for the fluent mass, each chamber having said first and second locations for the fluent mass, said weight means comprising a plurality of weights mounted on the shaft, at least one weight being located adjacent the first location of each chamber.

8. The mechanism of claim 7 including: partition means located within the chamber of each csing to divide the chamber into the first and second locations.

9. The mechanism of claim 7 wherein: the fluent mass comprises a plurality of metal members located within the chamber.

10. The mechanism of claim 1 wherein: the means mounted on the shaft having a fluent mass comprises casing means having a chamber for accommodating the fluent mass, said chamber being concentric with the longitudinal axis of the shaft, and at least one partition means located within the chamber which upon rotation of the shaft confines the fluent mass to a first chamber portion in which the fluent mass augments the eccentricity of the weight means and a second chamber portion in which the fluent mass tends to balance the eccentricity of the weight means.

11. The mechanism of claim 10 wherein: said partition means comprises a pair of walls, one of said walls having a first section off set from the diameter of the chamber and a second wall having a section that extends generally to the first section.

12. The mechanism of claim 1 wherein: the means mounted on the shaft having a fluent mass comprises a casing means mounted on the shaft, said casing means having a chamber accommodating the fluent mass, and partition means located in said chamber providing said first and second locations for the fluent mass, said partition means comprising a pair of walls located in said chamber, one of said wall having a first section off set from the diameter of the chamber and a second wall having a section that extends generally parallel to the first section.

13. The mechanism of claim 12 wherein: the weight means is mounted on the shaft adjacent the first location for the fluent mass.

14. The mechanism of claim 12 wherein: the fluent mass comprise a plurality of metal members located in the chamber.

15. The mechanism of claim 1 wherein: the means to selectively rotate the shaft includes a reversible motor drivably connected to the shaft.

16. A drum and vibratory mechanism for a road compacting machine comprising: a generally cylindrical shell having opposite ends, end walls secured to opposite end portions of the shell, a shaft located within said shell between said end walls, means rotatably mounting the shaft on said end walls, drive means operable to selectively rotate the shaft in opposite directions, weight means secured to said shaft, said weight means having an eccentric first mass whereby upon rotation of said shaft said first mass causes the shaft to vibrate, means mounted on the shaft having a fluent second mass which upon rotation of the shaft in one direction moves the fluent second mass to a first location adjacent the weight means to augment the eccentric distribution of the first mass thereby producing high amplitude vibration of the shaft and shell and upon rotation in the opposite direction said fluent second mass moves from the first location to a second location generally diametrically spaced from the weight means to generally balance the shaft thereby producing low amplitude vibration of the shaft and shell.

17. The drum and vibratory mechanism of claim 16 wherein: the end walls have central apertures, said means rotatably mounting the shaft comprising housings extended through the apertures, means securing the housings to the end walls, and bearing means mounting opposite ends of the shaft on the housings.

18. The drum and vibratory mechanism of claim 16 wherein: the weight means comprise a pair of weights mounted on opposite end portions of the shaft, each weight having an eccentric located first mass.

19. The drum and vibratory mechanism of claim 16 wherein: the means mounted on the shaft having a fluent second mass comprises a casing mounted on the shaft, said casing having a chamber accommodating the fluent second mass, and partition means located in said chamber providing said first and second locations for the fluent second mass.

20. The drum and vibratory mechanism of claim 16 wherein: the means mounted on the shaft having a fluent second mass comprises a pair of casings secured to opposite end portions of the shaft, each casing having a chamber concentric about the shaft accommodating fluent second mass, and partition means located in each chamber providing said first and second locations for the fluent second mass.

21. The drum and vibratory mechanism of claim 20 wherein: the weight means comprise a pair of weights mounted on the shaft adjacent the casings, each weight having an eccentrically located first mass, said first mass being located adjacent the first locations for the fluent second mass.

22. The drum and vibratory mechanism of claim 20 wherein: the fluent second mass comprises a plurality of metal members.

23. The drum and vibratory mechanism of claim 16 wherein: the means mounted on the shaft having a fluent second mass comprises casing means having a chamber for accommodating the fluent second mass, said chamber being concentric with the longitudinal axis of the shaft, and at least one partition means located within the chamber which upon rotation of the shaft confines the fluent second mass to a first chamber portion in which the fluent second mass augments the eccentricity of the weight means and a second chamber portion in which the fluent second mass tends to balance the eccentricity of the weight means.

24. The drum and vibratory mechanism of claim 23 wherein: said partition means comprises a pair of walls, one of said walls having a first section off set from the diameter of the chamber and a second wall having a section that extends generally parallel to the first section.

25. The drum and vibratory mechanism of claim 16 wherein: the means mounted on the shaft having a fluent second mass comprises a casing means mounted on the shaft, said casing means having a chamber accommodating the fluent second mass, and partition means located in said chamber providing said first and second locations for the fluent second mass, said partition means comprising a pair of walls located in said chamber, one of said walls having a first section off set from the diameter of the chamber and a second wall having a section that extends generally parallel to the first section.

* * * * *